US006581453B1

(12) United States Patent
Bjørnstad

(10) Patent No.: US 6,581,453 B1
(45) Date of Patent: Jun. 24, 2003

(54) METHOD AND APPARATUS FOR DETECTING AND LOCALIZING UNWANTED MATTER INTERNALLY IN A PIPE STRING

(76) Inventor: Thor Bjørnstad, Lande, N-4513 Mandal (NO)

( * ) Notice: Subject to any disclaimer, the term of this patent is extended or adjusted under 35 U.S.C. 154(b) by 0 days.

(21) Appl. No.: 09/600,327

(22) PCT Filed: Jan. 12, 1999

(86) PCT No.: PCT/NO99/00009

§ 371 (c)(1),
(2), (4) Date: Nov. 14, 2000

(87) PCT Pub. No.: WO99/36659

PCT Pub. Date: Jul. 22, 1999

(30) Foreign Application Priority Data

Jan. 14, 1998 (NO) ..... 980160

(51) Int. Cl.[7] ..... E21B 47/022; E21B 17/07; E21B 47/00; G01D 9/42

(52) U.S. Cl. ..... 73/152.01; 73/152.54; 73/152.56; 73/152.46; 175/40; 166/253.1; 166/255.1

(58) Field of Search ..... 73/152.01, 152.54, 73/152.56, 152.46, 12.06, 12.13; 175/40, 49; 166/254.1, 250.13, 253.1, 255.1

(56) References Cited

U.S. PATENT DOCUMENTS 1,654,819 A * 1/1928 Kinley ..... 73/152.56
2,126,741 A * 8/1938 Culbertson ..... 33/205
2,764,310 A * 9/1956 Bendar ..... 220/40
2,776,564 A * 1/1957 Montgomery et al. ..... 73/151
2,824,378 A * 2/1958 Stokes ..... 33/175
3,086,167 A * 4/1963 Chaney et al. ..... 324/1
3,352,360 A * 11/1967 Kirby, II ..... 166/55.1
3,550,444 A * 12/1970 Reardon ..... 73/152
3,653,468 A * 4/1972 Marshall ..... 188/1 C
4,110,688 A * 8/1978 Bailey ..... 324/208
4,169,483 A 10/1979 Bonn ..... 134/94
4,204,426 A * 5/1980 Patton et al. ..... 73/151
4,242,771 A 1/1981 Knapp ..... 15/104.06 R
4,452,306 A 6/1984 Polley ..... 166/155
4,498,932 A 2/1985 Kruka ..... 134/8
4,923,011 A 5/1990 Skipper ..... 166/311
5,012,866 A 5/1991 Skipper ..... 166/170
5,183,113 A * 2/1993 Leaney et al. ..... 166/316
5,732,774 A 3/1998 Haggard ..... 166/153
6,209,391 B1 * 4/2001 Dallas ..... 73/152.46

* cited by examiner

*Primary Examiner*—Daniel S. Larkin
*Assistant Examiner*—David J. Wiggins
(74) *Attorney, Agent, or Firm*—Knobbe, Martens, Olson & Bear, LLP

(57) ABSTRACT

A method and a device for detecting and localizing unwanted matter, e.g., cement deposits, internally in a drill string. A sleeve-shaped indicator body is dropped down through the drill string while the same occupies an operative position. Then, the indicator body lands either in a seat at the lower end of the drill string, or the indicator body becomes stuck within a pipe section at a higher level in the drill string. The drill string overlying the position of the indicator body may be considered free of deposits formed on the pipe section walls thereof, and these pipe sections thus may be re-used without any further examination or cleaning. If stuck at a higher level, the indicator body is subsequently localized at the surface through examination in context of disassembling the drill string. The indicator body also may comprise an indicator element that provides a detection signal or sign for its detection and localizing on the surface.

18 Claims, 3 Drawing Sheets

METHOD AND APPARATUS FOR DETECTING AND LOCALIZING UNWANTED MATTER INTERNALLY IN A PIPE STRING

BACKGROUND OF THE INVENTION

1. Field of the Invention

The present invention relates to a method for detecting and localizing unwanted matter, such as deposited cement, contaminants, etc. internally in a pipe string or tubing, preferably a drilling string of significant longitudinal extent, consisting of drilling pipes, preferably drill collars and a bit at the free outer end thereof, said method being based on dropping a weight body narrower than the bore diameter, down through the pipe string.

Likewise, the invention relates to a device comprising auxiliary means for use upon detecting and localizing cement deposits and other contaminant deposits within pipe strings and tubings having significant length extent and composed of built up pipe sections/pipe lengths/individual pipes.

2. Description of the Related Art

It is very important to have unwanted matter such as deposits and lumps localized and removed, from a pipe string which to a larger or smaller degree clog or throttle the drilling string bore. These bore diameter reducing coating build-ups and deposits result often from previous pumping of cement through the drilling string.

Lumps of contaminating substances from circulated cement slurry could represent a clogging phase if they land in the nozzles of the bit which, thus, become clogged or become so throttled that the circulation within the drilling string is influenced in a negative sense. Therefore, it is usual to "trip" (run in and pull out) the drilling string, test the individual pipe sections in storage position in the derrick, and clean the pipe section(s) containing deposits and/or lumps, prior to a new run of the drilling string in the well can be carried out.

A drilling string consists of pipe sections screwed together, each section normally consisting of three pipes or pipe lengths interconnected through screwing. After each time's use of a drill string, the screw connections between the individual pipe sections (a length of about 30 meters) are unscrewed. The pipe sections are usually not demounted into single pipes, but are stored on board the drilling platform in their full lengths, uppermost engaging supportingly into a finger board up in the derrick, resting with their lower ends on the drill floor. Within the derrick, at the level of the finger board, a person sits in order to drop a ball or another heavy weight body down through each pipe section.

If said weight body falls through the respective pipe section without being stopped, the pipe section is considered to be internally non-clogged and could be used for drilling again at a later point of time without further treatment.

If the weight body, on the other hand, is stopped within a pipe section, this is a sign of the occurrence of internal deposits, and the pipe section has to be cleaned, possibly after having been dismounted into the three pipe lengths thereof. Working in the derrick is associated with elements of risk, and this prior art detecting method is bothersome, troublesome and time-demanding. Each individual pipe section has to be tested no matter what place it took in the drill string.

SUMMARY OF THE INVENTION

The method and the device according to the invention allow in most cases, where no deposits occur, that one with certainty can assume that the entire drill string is sufficiently clean without having.to control each and every pipe section.

The method according to the invention distinguishes itself through the use of a sleeve-shaped/tubular indicator body with a smaller lateral measure than the diameter of the drill string bore and which, in situ, from a surface position is dropped down through the drill string, landing at a place further down within the drill string, said place, at a later stage, subsequently to disassembling the drill string, can be determined by testing the individual pipe sections, e.g., through a measure indication from one end of the pipe section to the other, in connection with the tripping in/storage of the individual pipe sections on the drill floor.

The sleeve-shaped/tubular indicator body can be adapted to emit radioactivity, or it may be provided with an active radio chip adapted to be detected by means of a magnetic field established outside that pipe section which at any time is being examined in order to recover the indicator body and determine the place positioned at the highest level, referred to the drill string's position of use, where deposits occur. Then, at this highest positioned place within the drill string, the deposits have stopped the further movement of the indicator body downwardly within the drill string, and above the determined highest positioned place there are no internal deposits, coatings or other accumulations of cement or mud constituents, formation sand, etc. As soon as one has positionally determined and recovered the indicator body and, thus, localized the pipe section exhibiting deposits, the remaining pipe sections which, thus, were positioned above that place within the drill string where the indicator body was stuck, can be considered as deposit-free internally. These pipe sections do not need any testing and may immediately be stored for subsequent use in the next run of the drill string. On the other hand, pipe sections which occupied positions within the drill string below said recorded deposit's "highest place", may contain coatings. Therefore, the indicator body is dropped once more down into the remaining part of the drill string.

At one end thereof, the end being the lowermost in the position of use, the indicator body may be formed with an external, conical, downwardly tapering stop portion. A special pipe piece having an externally threaded socket at one end thereof and an internally threaded pin at the other end, is, thus, formed for interconnection with an overlying drill pipe of the drill string and an underlying drill collar of the same. The special pipe piece has a stepped bore comprising two coaxial bore portions passing into each other through a short transition portion connecting the upper bore portion, the diameter thereof agreeing with the bore diameter of the overlying drill pipe, the latter diameter exceeding the diameter of an underlying bore portion which agrees with the diameter of the underlying drill collar. In the transition between the two longitudinal bore portions having different diameters, this special pipe piece has an internal, conical, downwardly tapering seat which is substantially complementary to the external, conical stop portion of the indicator body at the lower end thereof.

The indicator body may, in situations where no deposits exist in the upper pipe sections of a drill string, be adapted to point this out immediately after hauling the special pipe piece up in connection with the drill string's pulling up (tricing), namely upon inspection of the special pipe piece as the first detecting/localization operation, in order to ascertain whether the indicator body has landed in the seat or not.

In order to remove the indicator body in case it has stopped in an area of deposits, a tool may be used, said tool being lowered down into the pipe section. This hoisting tool may have the form of a U-shaped hoop having somewhat resilient U-hoop legs in the plane of the legs and an upper, heavy web loading the tool with a weight. The tool is hoisted down into the pipe concerned, suspended from a line attached to said web at the central point thereof. Laterally, the free outer ends of the U-hoop legs are directed away from each other. Internally, the indicator body has a circumferential groove in communication with the bore.

Uppermost, the indicator body may be formed with a conical, tapering insertion aperture for guiding said U-hoop-shaped tool and temporary clamping of the two, possibly three oppositely directed free outer ends which, thereafter, resile out into engagement position in the area of said internal circumferential groove, so that the upper faces on said outwardly directed, free outer ends of the U-legs engage in below the downwardly facing face defining the internal circumferential groove from above, whereupon the indicator body can be hoisted up and used once more.

For localizing the pipe section of the disassembled drill string within which the indicator body is positioned immediately, the indicator body may have one of two advantageous embodiments.

In one embodiment, the indicator body is provided with a cord having a small plummet at the outer, free end thereof. The cord has such a length that a portion of it will project out from a pipe section's end if the indicator body itself has got stuck within a pipe section, irrespective of where in the pipe section the wedging of the indicator body did arise. The cord may e.g. have a length between indicator body and plummet of almost 30 meters.

In a second embodiment, a tubular indicator body according to the invention has a length substantially corresponding to the length of the pipe section, i.e., about 30 meters, a wedging of this long indicator body anywhere in the pipe section concerned will cause an end portion of the tubular indicator body to project out from the upper end. This situation can be recorded as soon as the respective pipe section is in the process of being pulled up. Overlying pipe sections of the pipe string can be considered as deposit-free without any need for internal cleaning.

A non-restricting exemplary embodiment of the uses and designs of the invention appears from the attached drawings, wherein:

FIG. 1 shows an axial section through a lower portion of a is drill string vertically orientated in the figure, and where a special pipe piece according to the invention is mounted in through interconnection by screwing with partly an overlying drill pipe section, partly an underlying drill collar;

FIG. 2 corresponds completely to FIG. 1 in respect of the drill string portion, but here a sleeve-shaped/tubular indicator body, which has been dropped down through the drill string from a surface position, has landed in the special pipe piece's seat with its complementarily shaped lower end;

FIG. 3 is a partial view showing an axial section through a pipe section and a therein stuck indicator body;

FIG. 4 corresponds to FIG. 3, but here a hauling tool has been lowered down from a surface position, said tool being connected to the end of a cord and serving to be brought into a firm engagement with an indicator body stuck within a pipe section, in order to haul it up by means of the cord;

DETAILED DESCRIPTION

Figure 1:
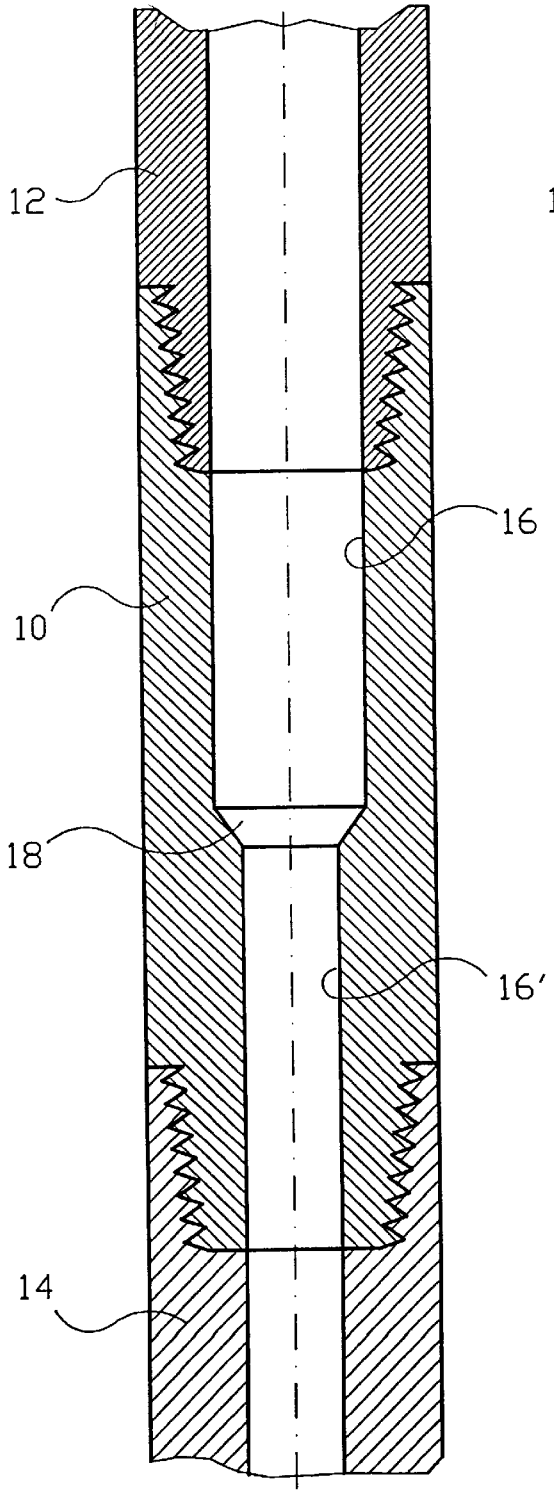
Figure 2:
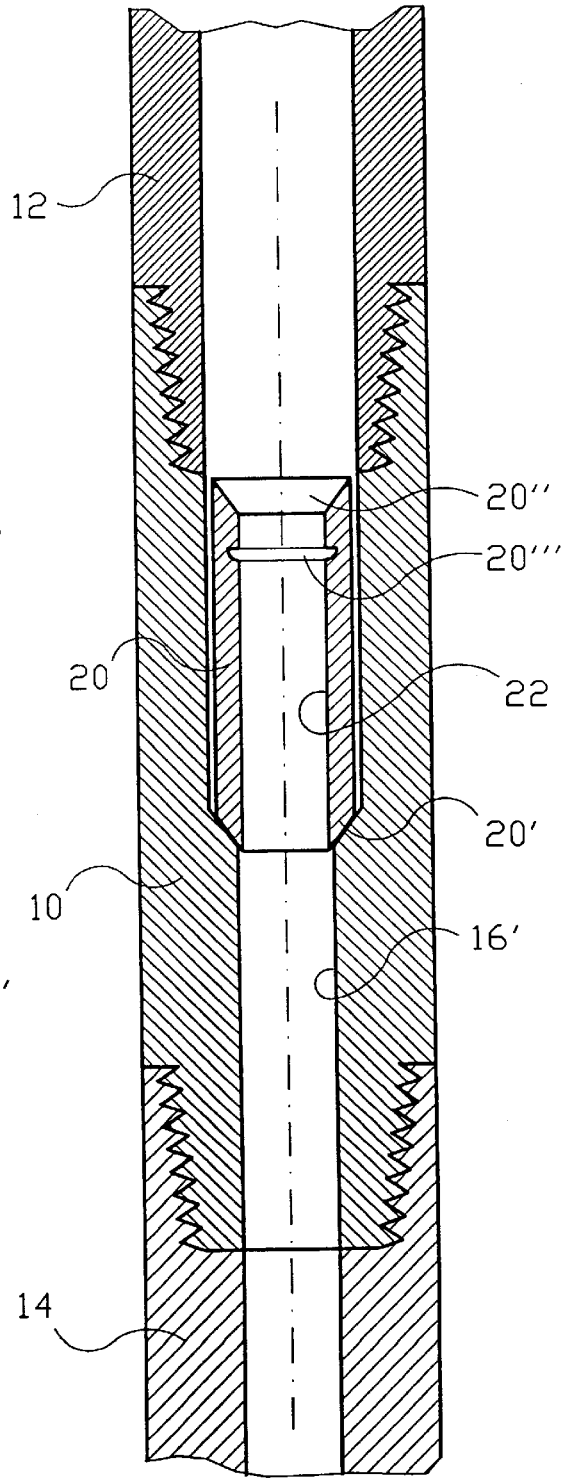

First, reference is made to FIGS. 1 and 2, showing a partial view of a drill string, in which a special pipe piece 10 has been mounted in between and, at the ends thereof, screwed firmly to an overlying drill pipe/pipe section 12 and an underlying drill collar 14, respectively.

The special pipe piece 10 has an upper, central bore portion 16 having a diameter corresponding to the overlying pipe section's 12 bore diameter, and a lower bore portion 16' extending coaxially with the upper bore portion 16 and having a smaller diameter, corresponding to the diameter of the underlying drill collar 14.

Between the bore portions 16 and 16' of the special pipe piece 10, a short transition bore portion 18 has been formed, forming an internal, conical, downwardly tapering seat.

Figure 5:
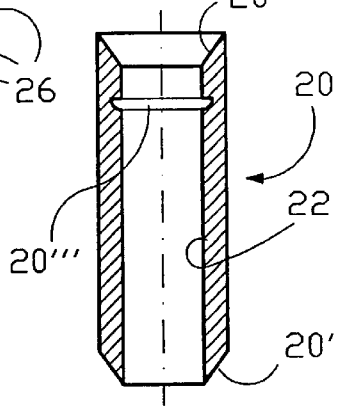
FIG. 5 shows the indicator body separately in axial section.
Figure 4:
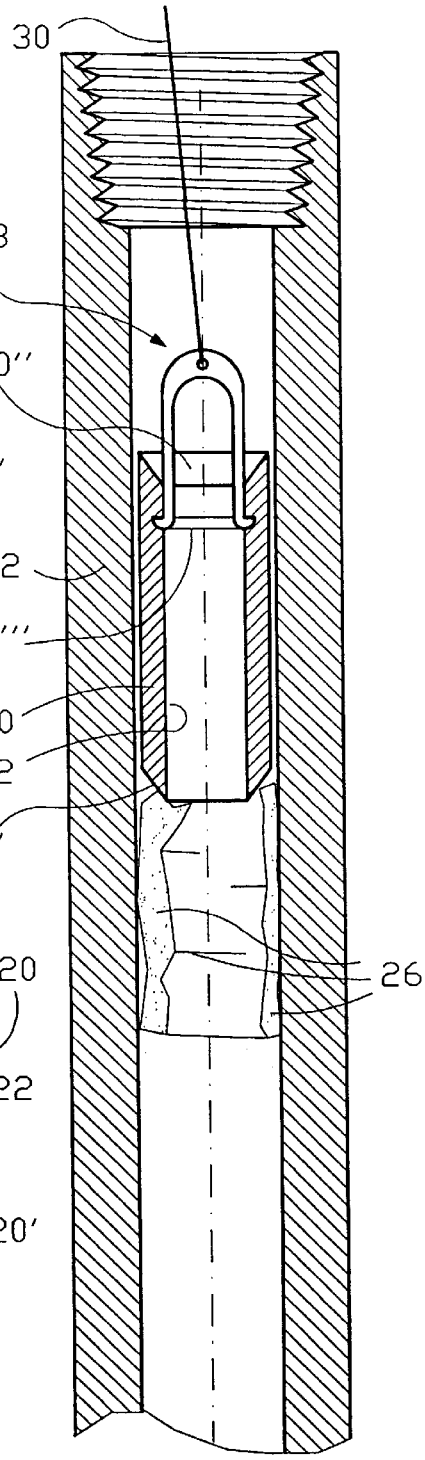

A sleeve-shaped or tubular indicator body 20 having a through-going bore 22, said body being shown separately in FIG. 5, has a lower, pointed end portion 20' which is substantially complementary to the seat 18 of the special pipe piece 10. The indicator body 20 exhibits an internal, conical, downwardly tapering guide face 20" at the upper end thereof and is, below the same, formed with an internal circumferential groove 20'" communicating with the bore 22.

The sleeve-shaped indicator body 20 has an outer diameter somewhat smaller than the bore diameter of the pipe section 12 and exceeding the bore diameter of the drill collar 14. The lower conical end portion 20' is, as mentioned, complementary to the seat 18 in the special pipe piece 10, and these will get in engagement, FIG. 2, in cases where the indicator body 20 which has been dropped from a surface position, falls without hindrances through all overlying pipe sections, of which the pipe section 12 is the lowermost. Below the drill collar 14, only drill collars exist down to the bit.

If one, when carrying out a method for detecting and localizing internal deposits, ascertains that the indicator body 20 has landed in the seat 18, this indicates unambiguously that all overlying pipe sections of the drill string are free of cement deposits or other unwanted deposits. Thus, these pipe sections 12 do not need to undergo further inspection when the drill string has been pulled up and disassembled for storage of the individual pipe sections on the drill floor and in the finger board in the derrick.

The drill collars 14 below the special pipe piece 10 of the drill string should in any case be examined in order to detect and localize cement deposits, etc. and, possibly, cleaned prior to the next time's run of the drill string. Such examination can be carried out in the same manner by using an indicator body 20 having a smaller diameter.

When the indicator body 20 has landed in the internal seat 18 in the special pipe piece 10, it is easy to get the indicator body 20 brought out of the pipe piece 10.

Figure 3:
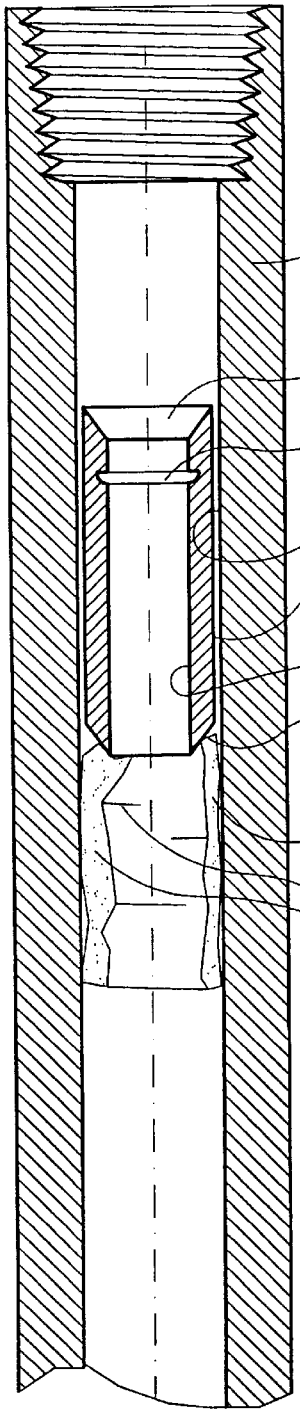
Figure 6:
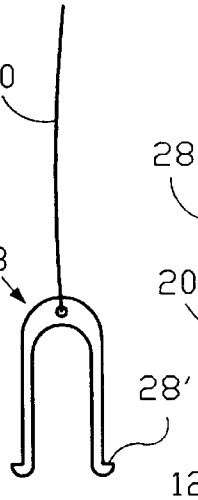
FIG. 6 shows the pulling-up tool separately in side elevation view.

If the indicator body 20 has gotten wedged or in some other way has been stuck in internal deposits 26 in a pipe section 12, see FIG. 3, the indicator body 20 may have been stuck in the middle portion of a pipe section, from where the distance is about 15 meters to each end.

In accordance with the present invention it is, therefore, designed a simple withdrawal tool 28 to enable withdrawal of the indicator body 20 when the pipe section 12*a* concerned has been placed on the drill floor in connection with the disassembling of the drill string.

The withdrawal tool 28 is suspended from a hoisting cord 30 and is formed as a U-shaped hoop, the legs thereof being resilient toward and away from each other. The web is relatively thick and heavy, forming a fastener at a through-going lateral hole for said hoisting cord 30. The outer, free ends 28' of the U-hoop legs are bent about 90°, pointing away from each other.

When the withdrawal tool 28 is lowered down into the indicator body 20, the outer, free ends 28' come into guided, inwardly displacing contact with the upper, funnel-shaped aperture 20", such that the free outer ends 28' of the resilient U-hoop legs are kept in this inwardly pressed position of readiness until they a short time afterwards are positioned at the same level as the internal circumferential groove 20'", into which the free outer ends resile and establish a firm and secure engagement. Thereupon, it only remains to pull the cord 30 upward, whereby the withdrawal tool 28 and the indicator body 20 accompany the same and eventually are removed from the pipe section which, thus, is cleaned and freed from the deposits 26.

Thereupon, the indicator body 20 is once more dropped into the remaining part of the drill string, and the operation is repeated until the indicator body has landed in the special pipe piece 10.

Figure 7:
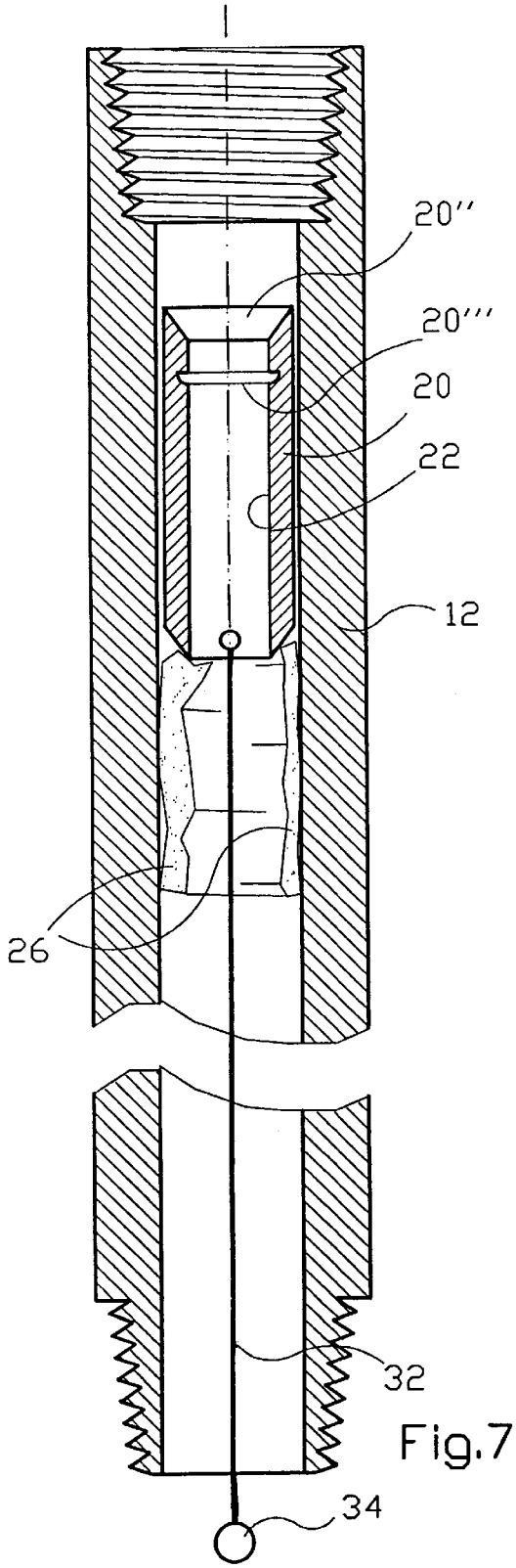
FIG. 7 shows a special embodiment in which, in the position of use, the indicator body, at the lower end thereof, is provided with a downwardly suspended cord having a plummet at its lower end.
Figure 8:
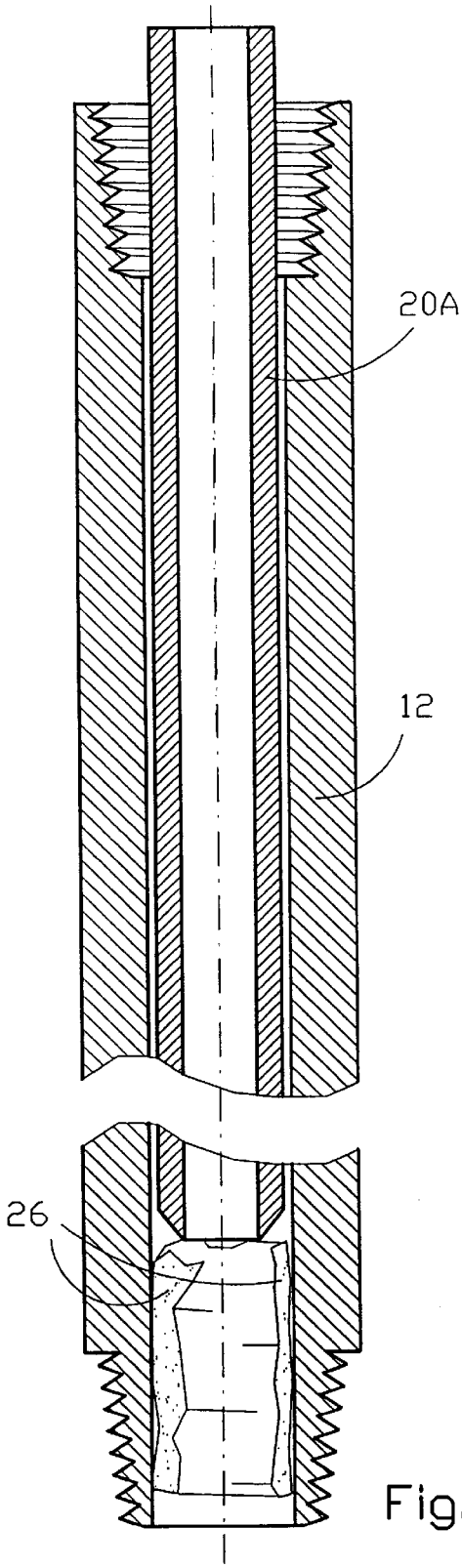
FIG. 8 shows a very long indicator pipe having a length corresponding to each of the pipe sections (30 meters) included in the drill string, and in which this tubular indicator body/indicator pipe has been stuck at the lower end of a pipe section.

In FIGS. 7 and 8, two advantageous embodiments are shown.

In the embodiment of FIG. 7, where a sleeve-shaped indicator body 20 has been stuck in underlying deposits 26 within a pipe section 12, the lower end of the indicator body 20 is provided with an indicator cord 32 having a small plummet 34 at the end thereof. The cord 32 has a longitudinal extent exceeding a pipe section'approximately, 30 meters, to allow the plummet 34, by means of the cord 32, to project out from the closest underlying pipe section end in case the indicator body 20 has become stuck in deposits. In most cases, the pipe section bore is not so fouled with deposits that it is entirely clogged, prohibiting the passage of the cord 32 and the plummet 34 in a downward direction. The pipe section in which the indicator body 20 might have got stuck, will, during tripping, immediately be detected based on the fact that the cord 32 with the plummet 34 is visible below the lower portion of the drill pipe 12.

In FIG. 8 is shown a particular embodiment for a tubular indicator 20A having a length corresponding to the length of a pipe section, i.e. about 30 meters. Irrespective of where in the pipe section 12 this tubular indicator body 20A has got stuck, an end portion thereof will project outside an end of the pipe section 12 and, immediately, detect and localize the lowermost pipe section of the drill string exhibiting deposits 26 to be removed. As a consequence of the indicator body's 20A considerable weight, any deposits would normally be cleaned away during the displacement of the indicator body 20A through the drill pipes 12. If the indicator body 20 is treated with a radioactive substance or in some other way enabled to emit radioactivity, possibly provided with an active radio chip, the indicator body 20 could be detected during the tripping by means of an external detector located on the drill floor. Preferably, the indicator body 20 should be provided with a bore 22, so that drill fluid can be circulated within the well also after the indicator body has been dropped down.

What is claimed is:

1. A method for detecting and localizing unwanted matter within pipe sections and drill collars included in a drill string, comprising:

dropping a tubular indicator body from a surface position down through the drill string, said indicator body having an insignificantly smaller external diameter than the bore diameter of the drill string, the indicator body landing either in a seat at the lower end of the drill string or being stopped and retained by unwanted matter within a pipe section higher up in the drill string; and when said drill string is subsequently disassembled, and prior to re-use in a drill string, examining individual pipe sections to localize the indicator body position, the localizing thereof indicating that its pipe section contains unwanted matter, and that overlying pipe sections are free of said unwanted matter formed on the internal walls thereof.

2. A device for detecting and localizing unwanted matter within pipe sections and drill collars included in a drill string, comprising:

a pipe piece which is formed with an internal seat, and which is mounted within the lower end of the drill string; and a tubular indicator body having a through-going bore and a lower end stop portion adapted to engage said seat within said pipe piece of the drill string, the indicator body also having an insignificantly smaller external diameter than the bore diameter of the drill string, and the indicator body being configured to be dropped into the drill string from surface and landing either in said seat at the lower end of the drill string or being stopped and retained by unwanted matter within a pipe section higher up in the drill string, wherein the tubular indicator body comprises an indicator element which is detectable from outside a pipe section when said drill string is subsequently disassembled, the detection and localization of the indicator body within an individual pipe section indicating that the pipe section contains unwanted matter, and that overlying pipe sections are free of said unwanted matter formed on the internal walls thereof.

3. The device of claim 2, wherein said tubular indicator body has a lower, tapering end adapted to fit within a complementary shaped internal seat of said drill string pipe piece and wherein said seat has an upper diameter corresponding to an overlying pipe section's bore diameter and a lower diameter corresponding to an underlying drill collar's bore diameter.

4. The device of claim 3, wherein the indicator body has an upper tapering inlet portion having an upper diameter substantially corresponding to an overlying pipe section's bore diameter, and having a lower transition portion having a diameter substantially corresponding to an underlying collar's bore diameter.

5. The device of claim 2, wherein the indicator body has an internal circumferential groove to enable its withdrawal from the pipe string.

6. The device of claim 2, wherein said pipe piece is formed with threaded end portions for interconnection by screwing with coaxial, threaded end portions of drill pipes or collars.

7. The device of claim 2, wherein the seat forms a transition portion between an upper bore portion, the diameter thereof corresponding to the overlying pipe's diameter, and an underlying, narrower bore portion, the diameter thereof corresponding to an underlying pipe's bore diameter.

8. The device of claim 2, wherein the indicator element emits radioactivity in order to detect and localize the indicator body.

9. The device of claim 2, wherein the indicator element comprises a plummet which depends therefrom on an indicator cord in order to detect and localize the indicator body.

10. The device of claim 2, wherein the indicator body has the form of an elongated pipe, having a length substantially corresponding to the length of the pipe section, so that an end portion of the indicator body projects out from the end of the pipe section upon the disassembly of the pipe string.

11. The device of claim 2, additionally comprising a withdrawal tool for withdrawing the indicator body from a pipe section after the indicator body is dropped into the drill string containing the pipe section, wherein the withdrawal tool comprises a U-shaped hoop having resilient legs adapted to releasingly engage the indicator body, and wherein the hoop has a hoisting cord attached thereto.

12. The device of claim 2, wherein the indicator element comprises an active radio chip which emits radio signals in order to detect and localize the indicator body.

13. A device for detecting and localizing unwanted matter within pipe sections and drill collars included in a drill string, comprising a pipe piece formed with an internal seat and mounted within the lower end of the drill string, and also comprising a tubular indicator body having a through-going bore and a lower end adapted to engage said seat within said pipe piece, and wherein the indicator body comprises an indicator element which emits radioactivity in order to detect and localize the indicator body.

14. A device for detecting and localizing unwanted matter within pipe sections and drill collars included in a drill string comprising a pipe piece formed with an internal seat and mounted within the lower end of the drill string, and also comprising a tubular indicator body having a through-going bore and a lower end adapted to engage said seat within said pipe piece, and wherein the indicator body has the form of an elongated pipe having a length substantially corresponding to the length of the pipe section, so that an end portion of the indicator body projects out from the end of the pipe section upon disassembling the drill string into individual pipe sections.

15. A device for detecting and localizing unwanted matter within pipe sections and drill collars included in a drill string, comprising a pipe piece formed with an internal seat and mounted within the lower end of the drill string, and also comprising a tubular indicator body having a through-going bore and a lower end adapted to engage said seat within said pipe piece, and wherein the indicator body comprises an indicator element comprising a plummet which depends from the indicator body on an indicator cord in order to detect and localize the indicator body.

16. A device for detecting and localizing unwanted matter within pipe sections and drill collars included in a drill string, comprising a pipe piece formed with an internal seat and mounted within the lower end of the drill string; and also comprising a tubular indicator body having a through-going bore and a lower end adapted to engage said seat within said pipe piece, and wherein the indicator body comprises an indicator element comprising an active radio chip which emits radio signals in order to detect and localize the indicator body.

17. The device of claim 2, wherein said tubular indicator body has a lower, tapering end adapted to fit within a complementary shaped internal seat of said drill string pipe piece.

18. The method of claim 1, additionally comprising removing said indicator body from unwanted matter in a pipe section and dropping said indicator body into a remaining section of the drill string to test for additional unwanted matter therein.

* * * * *